US005512873A

United States Patent [19]

Saito et al.

[11] Patent Number: 5,512,873

[45] Date of Patent: Apr. 30, 1996

[54] HIGHLY-ORIENTED DIAMOND FILM THERMISTOR

[76] Inventors: Kimitsugu Saito, Nojyu E-103, 4-1-15 Fududa, Tarumi-ku, Kobe 655; Koichi Miyata, 2-13-18, J-404, Koyo, Tarumiku, Kobe 655, both of Japan; John P. Bade, Jr., 2803-D Bainbridge Dr., Durham, N.C. 27713; Brian R. Stoner, 2659 Broad Oaks Pl., Raleigh, N.C. 27603; Jesko A. von Windheim, 7709 Blufftop Ct., Raleigh, N.C. 27615; Scott R. Sahaida, 700 E. Whitaker Mill Rd., Raleigh, N.C. 27606

[21] Appl. No.: 258,608

[22] Filed: Jun. 10, 1994

Related U.S. Application Data

[63] Continuation of Ser. No. 196,422, Feb. 15, 1994, which is a continuation of Ser. No. 61,433, May 4, 1993.

[51] Int. Cl.[6] ..... H01C 7/10

[52] U.S. Cl. ..... 338/22 SD; 257/77

[58] Field of Search ..... 338/22 R, 22 SD; 156/643; 257/77

[56] References Cited

U.S. PATENT DOCUMENTS

| | | | |
|---|---|---|---|
| 3,735,321 | 5/1973 | Bovenkerk | 338/22 R |
| 3,904,505 | 9/1975 | Aisenberg | 204/298 |
| 3,961,103 | 6/1976 | Aisenberg | 427/39 |
| 4,670,968 | 6/1987 | Mikami et al. | 29/576 B |
| 4,806,900 | 2/1989 | Fujimori et al. | 338/22 R |
| 4,822,466 | 4/1989 | Rabalais et al. | 204/192.15 |
| 4,891,329 | 1/1990 | Reisman et al. | 436/61 |
| 5,001,452 | 3/1991 | Imai et al. | 338/13 |
| 5,002,899 | 3/1991 | Geis et al. | 437/173 |
| 5,066,938 | 11/1991 | Kobashi et al. | 338/22 SD |
| 5,081,438 | 1/1992 | Nakahata et al. | 338/22 SD |
| 5,082,359 | 1/1992 | Kirkpatrick | 359/642 |
| 5,086,014 | 2/1992 | Miyata et al. | 437/103 |
| 5,089,802 | 2/1992 | Yamazaki | 338/22 SD |

(List continued on next page.)

FOREIGN PATENT DOCUMENTS

| | | |
|---|---|---|
| 421397A1 | 4/1991 | European Pat. Off. . |
| 445998A1 | 9/1991 | European Pat. Off. . |
| 59-27754 | 2/1984 | Japan . |
| 59-137396 | 8/1984 | Japan . |
| 60-12747 | 1/1985 | Japan . |
| 61-3320 | 1/1986 | Japan . |
| 61-251158 | 11/1986 | Japan . |
| 64-55862 | 3/1989 | Japan . |
| 64-68966 | 3/1989 | Japan . |
| 1-158774 | 6/1989 | Japan . |
| 1-244399 | 9/1989 | Japan . |
| 2-273960 | 11/1990 | Japan . |
| 3-12966 | 1/1991 | Japan . |
| 3-94429 | 4/1991 | Japan . |
| 3-110866 | 5/1991 | Japan . |
| 3-120865 | 5/1991 | Japan . |
| 3-160731 | 7/1991 | Japan . |
| 3-263872 | 11/1991 | Japan . |
| 3-278463 | 12/1991 | Japan . |
| 3-278474 | 12/1991 | Japan . |
| 4-26161 | 1/1992 | Japan . |
| 4-26172 | 1/1992 | Japan . |
| 2243949 | 11/1991 | United Kingdom . |
| 2252202 | 7/1992 | United Kingdom . |

OTHER PUBLICATIONS

Geis, *Growth of textured diamond films on foreign substrates from attached seed crystals, Appl. Phys. Lett.*, 55:550–552 (1989).

*Primary Examiner*—Marvin M. Lateef

[57] ABSTRACT

The highly-oriented diamond film thermistor has a temperature sensing part formed of a highly-oriented diamond film grown by chemical vapor deposition. This highly-oriented diamond film satisfies the conditions that at least 65% of the film surface area is covered by (100) or (111) planes of diamond and the differences $\{\Delta\alpha, \Delta\beta, \Delta\gamma\}$ of Euler angles $\{\alpha, \beta, \gamma\}$, which represent the orientations of the crystal planes, simultaneously satisfy conditions, $|\Delta\alpha| \leqq 5°$, $|\Delta\beta| \leqq 5°$, $|\Delta\gamma| \leqq 5°$, between adjacent crystal planes.

18 Claims, 5 Drawing Sheets

SURFACE STRUCTURE OF DIAMOND FILM WITH HIGHLY ORIENTED (100) CRYSTAL PLANE

U.S. PATENT DOCUMENTS

| | | | |
|---|---|---|---|
| 5,099,790 | 3/1992 | Kawakami | 118/723 |
| 5,104,634 | 4/1992 | Calcote | 523/446 |
| 5,114,696 | 5/1992 | Purdes | 423/446 |
| 5,124,179 | 6/1992 | Garg et al. | 427/249 |
| 5,126,206 | 6/1992 | Garg et al. | 428/408 |
| 5,127,983 | 7/1992 | Imai et al. | 156/610 |
| 5,144,380 | 9/1992 | Kimoto et al. | 257/77 |
| 5,145,712 | 9/1992 | Jesser et al. | 427/38 |
| 5,169,676 | 12/1992 | Moran et al. | 427/575 |
| 5,171,732 | 12/1992 | Hed | 505/1 |
| 5,173,761 | 12/1992 | Dreifus et al. | 257/22 |
| 5,183,530 | 2/1993 | Yamazaki | 338/22 SD X |
| 5,204,145 | 4/1993 | Gasworth | 427/577 |
| 5,221,411 | 6/1993 | Narayan | 156/603 |
| 5,225,366 | 7/1993 | Yoder | 437/108 |
| 5,236,545 | 8/1993 | Pryor | 156/613 |
| 5,244,712 | 9/1993 | Eden | 428/142 |
| 5,250,149 | 10/1993 | Kimoto et al. | 156/612 |
| 5,252,174 | 10/1993 | Deguchi et al. | 156/612 |

STANDARD ORIENTATION OF CRYSTAL PLANE

SURFACE STRUCTURE OF DIAMOND FILM WITH HIGHLY ORIENTED (100) CRYSTAL PLANE

HIGHLY-ORIENTED DIAMOND FILM THERMISTOR

This is a continuation of co-pending application Ser. No. 08/196,422, filed on Feb. 15, 1994, which application is a continuation of pending prior application Ser. No. 08/061,433, filed 14 May 1993, and allowed 14 Dec. 1993, the disclosure of which is incorporated by reference herein in its entirety.

BACKGROUND OF THE INVENTION

1. Field of the Invention

The present invention relates to a high temperature semiconductor which is useful for an element for measuring temperature, more particularly to a highly-oriented diamond film thermistor having a fast response, and resistance to heat, radiation and chemicals, and a manufacturing process of the same.

2. Prior Art

Diamond is very hard and has a high thermal conductivity as well as an excellent resistance to heat, radiation and chemicals. Recently, it became possible to prepare a diamond film by chemical vapor deposition (CVD). Speaker diaphragms and heat sinks for semiconductor devices are being developed. Diamond free from impurities is electrically insulating, but diamond can be converted to p-type semiconductor by boron (B)-doping. The band gap of this p-type semiconductor is very large (about 5.4 eV). Moreover, its semiconducting characteristics persist at high temperatures beyond 100° C. Heat resistant electric elements such as diodes and transistors using such semiconducting diamond are being developed. Another example is thermistor. Thermistor is an electronic device utilizing a property of semiconducting material that its resistance changes with temperature, and used as a temperature sensor. A thermistor most commonly used generally comprises metal oxides and is used in the temperature range up to 350° C. At present, there is an interest in thermistors made of diamond, because it is stable at higher temperature (H. Nakahata, T. Imai, H. Shiomi, Y. Nishibayashi and N. Fujimori, Science and Technology of New Diamond, pp. 285–289, 1990). Diamond has a high thermal conductivity and a small specific heat. Therefore, it is expected that a thermistor utilizing diamond has a fast response to temperature changes.

In the prior art thermistor utilizing diamond, polycrystalline diamond films grown on non-diamond substrates by CVD is used. The electrical resistance of the diamond film can be easily controlled by impurity doping during the CVD process. The diamond film has advantage over the single crystal diamond because it can be produced at low cost.

In the prior art thermistor, however, a diamond film having diamond crystals grown randomly on a substrate (a polycrystalline diamond film: PCD film) is used. Such a polycrystalline diamond film contains many grain boundaries and defects. Therefore, if the PCD film thermistor is operated in air at high temperature, the PCD film is oxidized and graphitized gradually from grain boundaries, and therefore a heat resistance of the thermistor is inferior to the thermistor made of single crystal diamond. The existence of grain boundaries and defects also cause a slow temperature response. Grain boundaries and defects also act as current leakage paths and therefore the uniformity in electric properties is deteriorated. Moreover, in a PCD film thermistor, there are different crystal planes such as the (100) and (111) planes on the surface of the diamond film. Such surface structure causes different intake of impurities in different crystal planes during the growth of semiconducting diamond films by CVD or ion implantation which leads to nonuniform electrical characteristics of the thermistor.

If a single crystal diamond (SCD) is used as a substrate, a SCD film can be formed on the substrate. Problem aforementioned can be solved by using such a SCD film. SCD substrates, however, are very expensive and therefore the manufacturing cost of the thermistor becomes very high. Moreover, the surface area of a commonly available single crystal diamond substrate is only 5×5 $mm^2$ and therefore a mass production of thermistor is impossible.

SUMMARY OF THE INVENTION

It is an object of the present invention to provide a highly-oriented diamond film thermistor with a low manufacturing cost, capable of mass production and having good electrical characteristics such as heat resistance and temperature response.

A highly-oriented diamond film thermistor according to the present invention comprises a temperature sensing part formed of a highly-oriented diamond film grown by CVD, in which at least 65% of the surface area of said diamond film consists of either (100) or (111) crystal planes, and the difference $\{\Delta\alpha, \Delta\beta, \Delta\gamma\}$ of Euler angles $\{\alpha, \beta, \gamma\}$, which represent the orientations of either (100) or (111) crystal planes, between the adjacent diamond crystals, simultaneously satisfy $|\Delta\alpha| \leqq 10°$, $|\Delta\beta| \leqq 10°$, and $|\Delta\gamma| \leqq 10°$.

FIGS. 1A and 1B are diagrams illustrating the highly-oriented diamond film which is one of constituents of the present invention. As one of examples, a surface structure of the highly-oriented diamond film with (100) crystal planes is shown. X-axis and Y-axis are perpendicularly intersecting each other in the surface of the film. The direction normal to the film surface is defined as Z-axis. The Euler angles $\{\alpha, \beta, \gamma\}$ represent the orientation of the crystal plane. Orientations of the (i)th and the adjacent (j)th diamond crystals are defined as $\{\alpha_i, \beta_i, \gamma_i\}$ and $\{|\alpha_j|, |\beta_j|, |\gamma_j|\}$ respectively. The differences of each angle between adjacent crystals is defined as $\{\Delta\alpha, \Delta\beta, \Delta\gamma\}$.

The Euler angles $\{\alpha, \beta, \gamma\}$ represent the orientation of crystal plane obtained by rotating the standard crystal plane around the axis 2, Y and Z of the standard coordinate by the angles of $\alpha$, $\beta$, $\gamma$ one after another.

In the present invention, the highly-oriented diamond film simultaneously satisfy $|\Delta\alpha| \leqq 10°$, $|\Delta\beta| \leqq 10°$, and $|\Delta\gamma| \leqq 10°$. Thus, the diamond crystals are highly oriented and therefore its heat resistance and temperature response are excellently as good as those of SCD film.

For (111)-oriented diamond films, the crystals are highly oriented and its heat resistance as well as temperature response are similarly excellent if the absolute values for the Euler angle difference are all 10° or less.

Such highly-oriented diamond films can be deposited on substrates, for example, by subjecting a mirror-finished silicon substrate to a microwave radiation while adding a negative bias on to the substrate in an atmosphere containing methane gas, then depositing diamond in a mixture of methane, hydrogen and oxygen by microwave plasma CVD.

In the present invention, the temperature sensing part of the thermistor comprises a highly-oriented diamond film of which at least 65% surface area is covered with either (100) or (111) planes. The highly-oriented diamond film may be used not only for the temperature sensing part but also for the basal insulating layer and/or the passivation layer. Since the misorientation between crystal planes of adjacent crystals is within ± 10° in the highly-oriented diamond film used in the present invention, crystal planes become larger for a prolonged CVD period, and finally the almost entire film surface may be covered by the same kind of crystal planes. Under such circumstances, the effect of grain boundaries can be ignored in the highly-oriented diamond film according to the present invention.

Thus, since there is almost no effect of grain boundaries in the present invention, the heat resistance in air at high temperature can be improved and a stable operation of the thermistor under high temperature and prolonged period can be achieved. Further, since the highly-oriented diamond film is excellent in crystallinity, its thermal conductivity and insulating property are better than PCD films.

Since the surface of diamond film is covered mainly by either (100) or (111) plane, impurities can be uniformly doped during the growth process of the semiconducting layer by CVD or ion implantation, and therefore its electrical characteristics become more uniform than in PCD films.

The ohmic electrodes used for electrical connection with the temperature sensing part should preferably be made of either Ti, W, Mo, Ta or Si or carbides or nitrides, materials of these elements because they are resistant to heat, adhesive to diamond and can have small contact resistances. If any deterioration of these electrodes is expected under certain circumstance of operation of the thermistor, a metal such as Au or Pt is coated on said electrode. In case the temperature sensing part is made of a low-doped semiconducting diamond film or an intrinsic semiconducting diamond film, preferably a highly-doped semiconducting diamond film is inserted between the electrode and the temperature sensing part to reduce the contact resistance between the electrode and the temperature sensing part. This highly-doped semiconducting diamond film may be formed by CVD or ion implantation.

BRIEF DESCRIPTION OF THE DRAWINGS

FIG. 1A shows the standard orientation of crystal plane, while FIG. 1B shows the surface structure of the diamond film in which the (100) planes are highly oriented;

DETAILED DESCRIPTION OF THE PREFERRED EMBODIMENTS

Figure 1A:
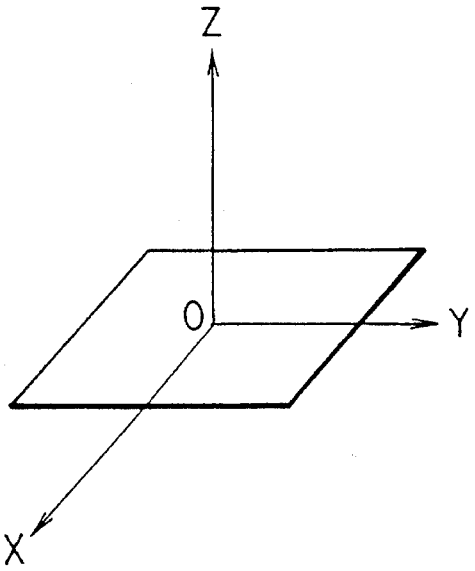
FIGS. 1A and 1B are diagrams showing the relationship between the surface structure of the highly-oriented diamond film and the Euler angles.
Figure 1B:
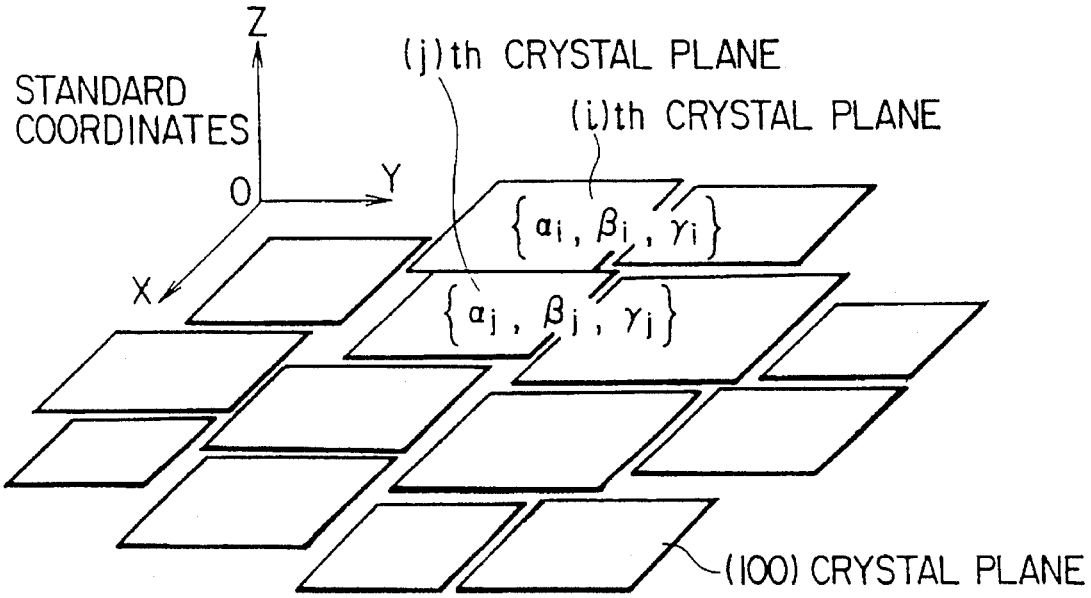
Figure 2:
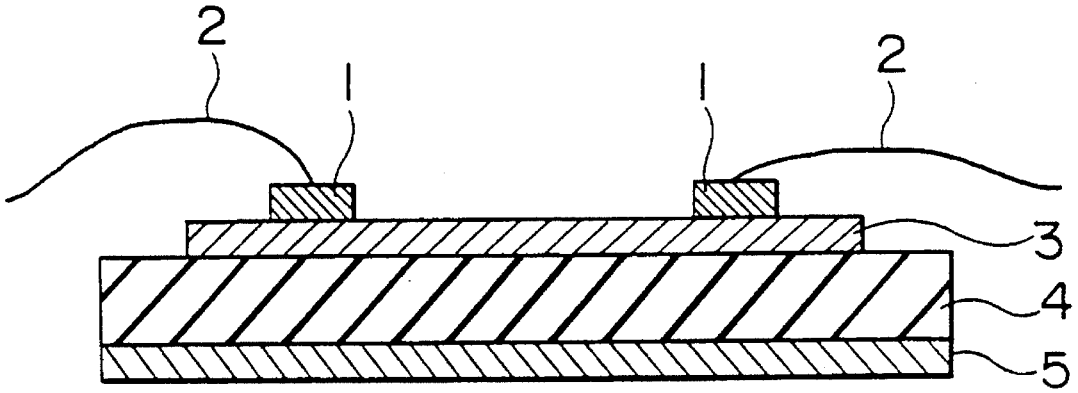
FIG. 2 is a cross sectional view showing a structure of the highly-oriented diamond film thermistor according to the first embodiment of the present invention.

The embodiment of the present invention will be described in reference to drawings attached. FIG. 2 is a cross sectional view showing a planer-type highly-oriented diamond film thermistor. A basal insulating diamond layer 4 is formed on a silicon wafer 5, a temperature sensing part 3 is patterned on the basal insulating diamond layer 4. A pair of ohmic electrodes 1 is formed on the temperature sensing part 3, and a lead wire 2 is connected to each ohmic electrode 1. The temperature sensing part 3 is formed of a highly-oriented diamond film as shown in FIG. 1. The basal insulating diamond layer 4 is formed of a highly-oriented intrinsic diamond film. The ohmic electrode 1 is formed of Au/Ti bi-layers, and the lead wire 2 is made of Au wire or the like.

In the thermistor thus fabricated, if a voltage is applied to the ohmic electrode 1 through the lead wire 2, a current flows according to the resistance of the temperature sensing part 3. The resistance of the temperature sensing part 3 changes according to its temperature. Therefore, from the resistance value of the temperature sensing part 3, determined by measuring the current between the electrodes, the temperature of the temperature sensing part 3 can be estimated. In the present invention, because the temperature sensing part 3 is formed of the highly-oriented diamond film, there is virtually no effect of grain boundaries and therefore a high response like in single crystal thermistors can be obtained.

The highly-oriented diamond film of the temperature sensing part 3 can be easily trimmed by various processing technique such as laser beam or discharge. By precisely controlling individual thermistor characteristics by trimming, the yield of product of the same quality can be increased.

In addition, since inexpensive and commercially available silicon substrates are used as the substrates and a highly-oriented diamond films can be formed on such substrates, mass production and reduction of manufacturing cost can be achieved.

Figure 5:
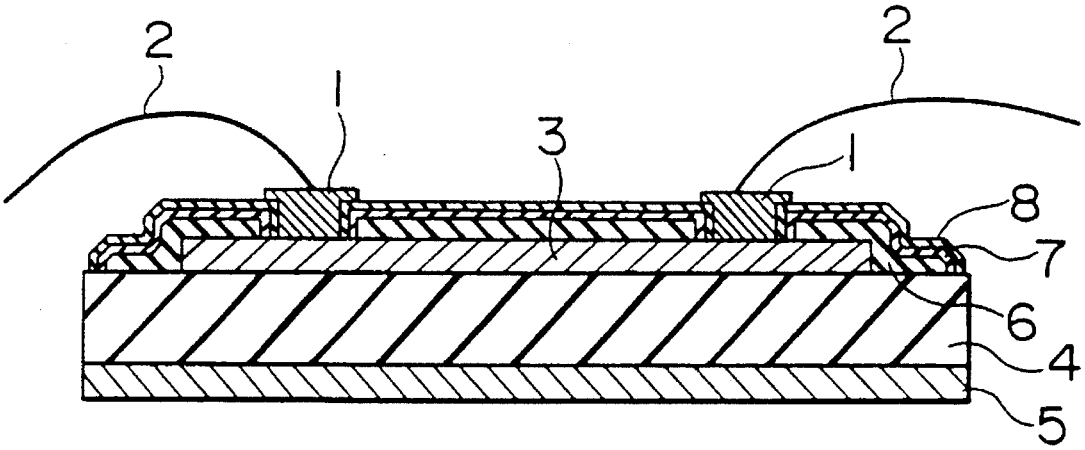
FIG. 5 is a cross sectional view showing a structure of the highly-oriented diamond film thermistor with a protection layer according to the second embodiment of the present invention.

The second embodiment of the present invention will be described in reference to FIG. 5. In FIG. 5, the same numerals are given to the same parts as in FIG. 2 without detailed explanation. In this embodiment, intrinsic diamond films 6 are formed both on a temperature sensing part 3 and as the basal insulating layer 4 so as to cover the temperature sensing part 3. A silicon nitride film 7 and a silicon oxide film 8 are formed as a double layer so as to cover the diamond film 6. This diamond film 6, silicon nitride film 7 and silicon oxide film 8 form a passivation layer for the temperature sensing part 3.

A thermistor having the passivation layer of the diamond film 6, the silicon nitride film 7 and the silicon oxide film 8 may be constructed by preferentially forming the diamond film 6 on the area of the temperature sensing part 3 except for the area where electrodes are to be formed, by selectively depositing the silicon nitride film 7 and the silicon oxide film 8 on the same area as for the diamond film 6, subsequently by selectively forming the ohmic electrodes 1 having a Au/Ti bilayer in the predetermined area.

Figure 6:
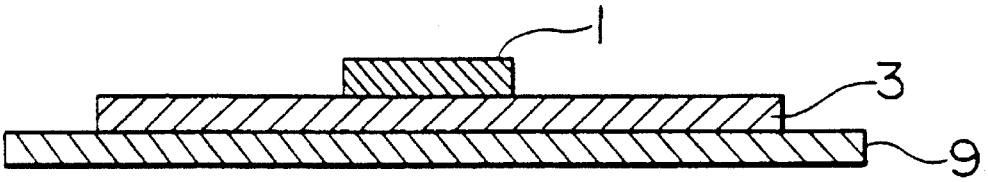
FIG. 6 is a Cross sectional view showing a structure of a vertical type thermistor according to the third embodiment of the present invention.

This embodiment exhibits similar effects as the first embodiment shown in FIG. 2, and improves the life-time of the thermistor even under severe environmental conditions as will be explained below:

That is, the highly-oriented diamond film is usually stable in air at temperatures up to 600° C. If the thermistor is operated at temperatures higher than 600° C., the surface of diamond is damaged by reactions with oxygen, which leads to changes in electrical characteristics of the temperature sensing part 3. In such a case, preferably the insulating passivation layer is provided on the temperature sensing part 3 as shown in FIG. 5. For the materials comprising the passivation layer, intrinsic diamond, silicon oxide, aluminum oxide, silicon nitride and aluminum nitride and a multi-layer of these materials may be used. The structure of a thermistor can be the planer type as shown in FIG. 2 or a vertical type in which each ohmic electrode is formed on the front and back surfaces of the temperature sensing part 3 as shown in FIG. 6. In the latter case, the ohmic electrode on the back surface can be a conductive substrate itself used for the deposition of the diamond film or can be newly formed after the removal of the substrate. The vertical type thermistor is advantageous for manufacturing because the thermistor can have a low resistance value.

In the vertical type thermistor shown in FIG. 6, the temperature sensing part 3 comprising a highly-oriented diamond film can be patterned in a predetermined form on an conducting substrate 9, and an ohmic electrode 1 comprising a Au/Ti bilayer is formed in the center of the temperature sensing part 3. In this vertical type thermistor, the conducting substrate 9 acts as another electrode. The current flows between the electrode 1 and the substrate 9 by applying a voltage, and by measuring the current, the temperature can be measured.

EXAMPLE 1

The diamond film thermistor having the structure as shown in FIG. 2 was prepared by steps 1 to 6 as described below.

(1) An one-inch diameter silicon wafer 5 of a (100) cut was used as a substrate to deposit a highly-oriented diamond film thereon. The substrate was placed in a chamber for microwave plasma CVD and treated for about 10 minutes under the following conditions: the source gas was 3% methane and 97% hydrogen, the gas pressure was 25 Torr, the gas flow rate was 300 ml/min, and the substrate temperature was 720° C. The power source of about 900 W was used to generate microwave, but the power was slightly adjusted so as to maintain the constant substrate temperature at 720° C. At the same time, a negative bias was applied to the substrate; the negative bias current was 12 mA/cm$^2$.

(2) Subsequently, the diamond film deposition was continued for 28 hours under the following conditions: the source gas was 0.5% methane, 99.4% hydrogen and 0.1% oxygen, the gas pressure was 35 Torr, the gas flow rate was 300 ml/min, and the substrate temperature was 800° C. As a result, the basal layer 4 of the highly-oriented diamond film with about 13 μm thickness was obtained. Electron microscope observation indicated that 70% of this film surface was covered with (100) crystal planes. From photographs of the film cross section, the maximum deviation of crystal plane positions was found to be 0.1 μm or less. Two electron micrographs of the film surface were taken each at angle +10° and −10° from the film surface normal and the inclinations of (100) crystal planes were determined from the photograph analysis. The results indicated that the differences of the surface inclinations between adjacent crystals satisfied all conditions of $|\Delta\alpha| \leqq 5°$, $|\Delta\beta| \leqq 5°$, and $|\Delta\gamma| \leqq 5°$ and $(\Delta\alpha)^2+(\Delta\beta)^2+(\Delta\gamma)^2=52$.

(3) The temperature sensing part 3 comprising a p-type semiconducting highly-oriented diamond film was formed on the basal layer 4 formed of the highly-oriented diamond film obtained from step (2) by a selective deposition technique. The film growth was continued for 7 hours under the following conditions: the source gas was 0.5% methane, 99.5% hydrogen and 0.1 ppm diborane ($B_2H_6$), the gas pressure was 35 Torr, the gas flow rate was 300 ml/min, and the substrate temperature was 800° C. As a result, a 1.5 μm thick p-type semiconducting highly-oriented diamond film was deposited for the temperature sensing part 3 with the identical surface morphology as the basal layer 4. Twelve thermistor units comprising this temperature sensing part 3 were formed on the basal layer 4.

(4) In order to stabilize the electrical characteristics of diamond, the samples were treated for 30 minutes in vacuum at 850° C. Then, the samples were cleaned by a heated mixture of chromic acid and concentrated sulfuric acid, followed by aqua regia and by RCA cleanings.

(5) For each temperature sensing part 3, ohmic electrodes 1 comprising Ti/Au bilayer were formed by a lithographic technique.

(6) The thermistor units were separated by a dicing saw, each mounted on a holder, and a Au lead wires 2 were bonded between the electrodes and holder pins to finish the diamond film thermistor according to the present invention shown in FIG. 2.

As a reference, a thermistor was prepared utilizing a PCD film. A silicon wafer of (100) cut was used as a substrate and its surface was polished for about 1 hour with diamond paste. Then, the growth of the basal insulating diamond layer and the temperature sensing part were formed by microwave plasma CVD for 14 hours under the following conditions: the source gas was 0.5% methane, 99.4% hydrogen and 0.1% oxygen, the gas pressure was 35 Torr, the gas flow rate was 300 ml/min, and the substrate temperature was 800° C. The thermistor having the structure shown in FIG. 2 was prepared according to the same steps 4 to 6 used for the preparation of the thermistor of the present invention.

Figure 3:
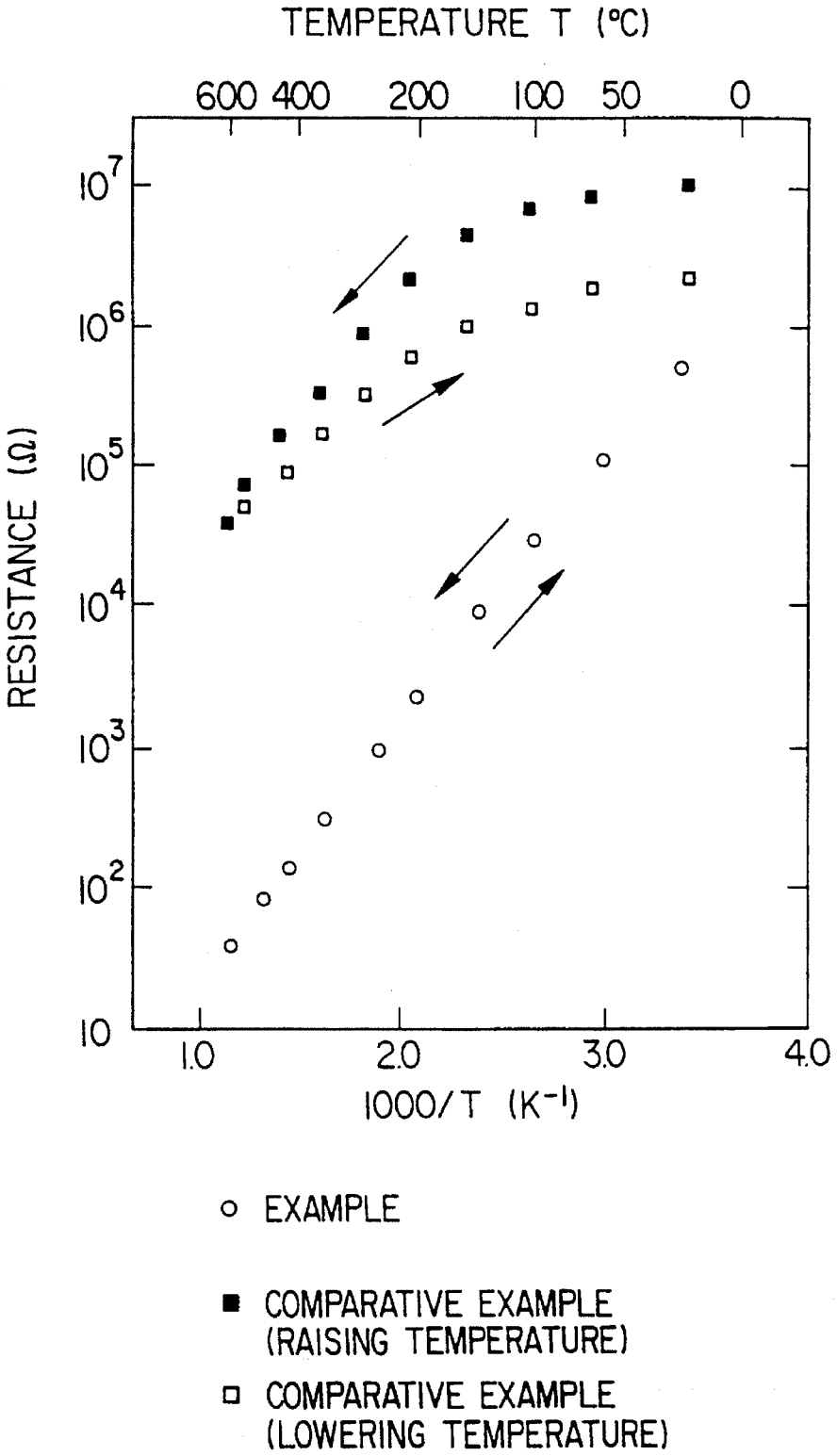
FIG. 3 is a graph showing temperature characteristics of thermistors according to the embodiment and comparative examples.

For these thermistors, the electrical resistance were measured from room temperature to 600° C. in air and the results obtained are shown in FIG. 3. In FIG. 3, changes in the electrical resistances are indicated for both raising and lowering temperature. The electrical resistance of the comparative sample show different curves between raising and lowering the temperature, and its resistance continued to decrease as the temperature cycles are repeated. This occurs by the graphitization of PCD films along grain boundaries at high temperature. On the other hand, the sample according to the present invention did not show such changes in the electrical resistances even though the temperature cycles are repeated. The temperature response was 1.0 sec for the comparative sample while 0.2 sec for the example of the present invention.

EXAMPLE 2

Figure 4:
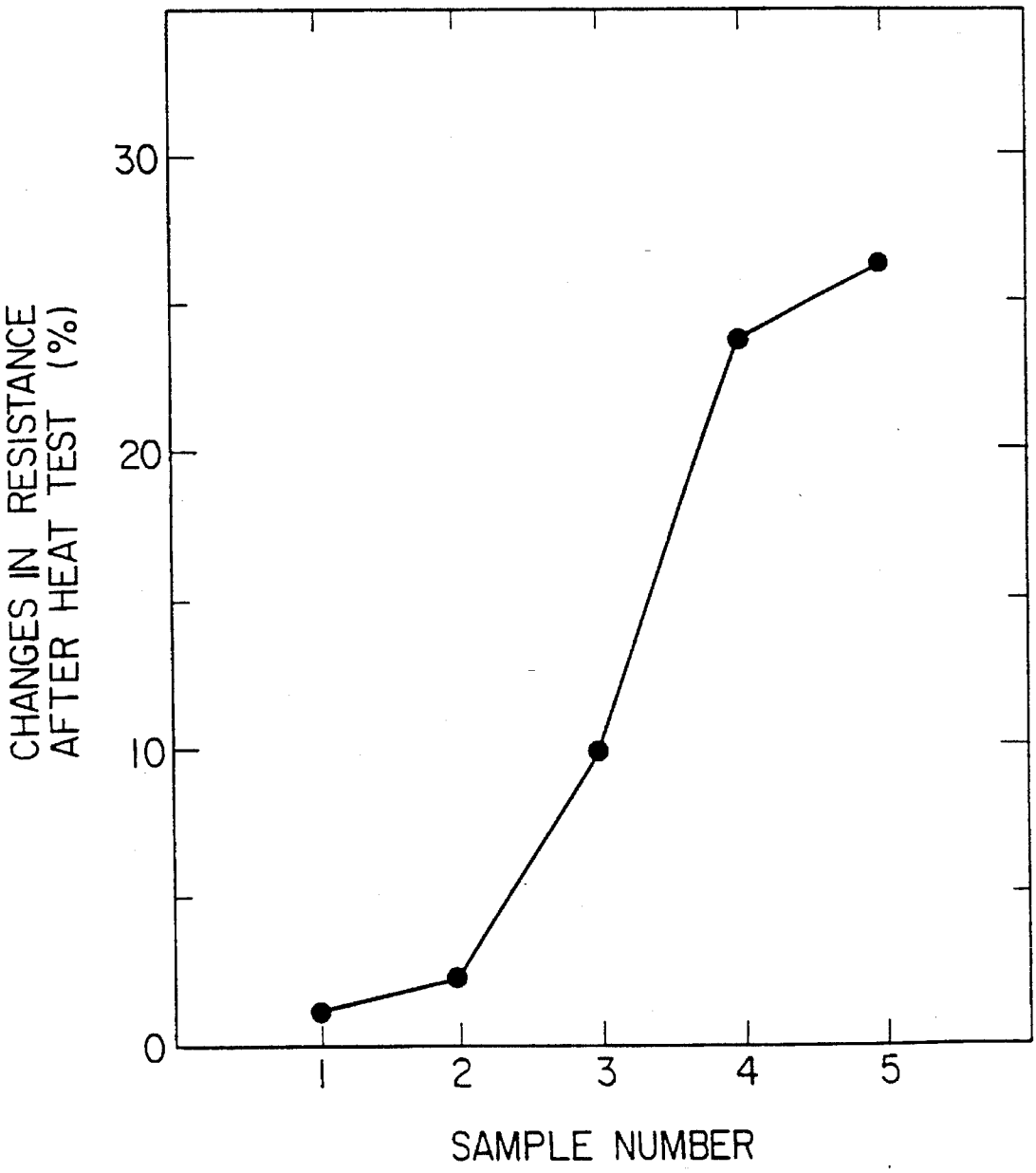
FIG. 4 is graph showing changes in the electrical resistance by the heat resistance test.

Thermistors having a structure shown in FIG. 2 were prepared by changing the conditions (see Table 1) used for the step 1 of Example 1, and the thermistors were put at 500° C. for 1000 hours to examine the heat resistance. The electrical resistance of each sample was determined at room temperature before and after the heat treatment. All samples showed decreases of the electrical resistance after the heat treatment. Changes in the resistances are shown in FIG. 4.

It should be noted in Table 1 that the conditions for the step 1 used for the sample 2 were the same as those for the step 1 in Example 1. The samples 1 and 2 were prepared according to the present invention and other samples 3, 4 and 5 are comparative examples.

TABLE 1

| Sample No. | growth conditions $CH_4$ (%) | $H_2$ (%) | Substrate temp. (°C.) | Coverage by (100) plane (%) | $\lvert\Delta\alpha\rvert$, $\lvert\Delta\beta\rvert$, $\lvert\Delta\gamma\rvert$ |
|---|---|---|---|---|---|
| 1 | 2.4 | 97.6 | 670 | 75 | All <10° |
| 2 | 3.0 | 97.0 | 720 | 70 | All <10° |
| 3 | 3.6 | 96.4 | 770 | 65 | Almost <10° but some >10° |
| 4 | 4.2 | 95.8 | 820 | 60 | All >10° |
| 5 | 4.8 | 95.2 | 870 | 55 | All >10° |

As clearly shown in FIG. 4, the samples 1 and 2 show only small changes in the resistance while the samples 3 to 5 showed significant changes in the resistance after the heat treatment. Therefore, in order to produce the thermistor having an excellent heat stability, it is necessary to use the highly-oriented diamond films according to the present invention.

EXAMPLE 3

A diamond thermistor having a passivation layer comprising a silicon oxide film, a silicon nitride film and a diamond film is shown in FIG. 5. The sample showed a linear change in the electrical resistance from room temperature up to 800° C. in air ($3\times10^5$ Ω at room temperature to 4.4 Ω at 800° C.). The sample was also subjected to temperature cycles from room temperature to 800° C., for 15 times, but no change in the resistance was observed.

The thermistor according to Example 1 but without the passivation layer showed about 13% reduction of the resistance at room temperature by subjecting to the same temperature cycles.

What is claimed is:

1. A highly-oriented diamond film thermistor comprising a temperature sensing part formed of a highly-oriented diamond film grown by chemical vapor deposition, in which at least 65% of the surface area of said diamond film surface consists of (100) crystal planes, and the differences {Δα, Δβ, Δγ} of Euler angles {α, β, γ} which represent the orientations of the crystal plane, simultaneously satisfy $\lvert\Delta\alpha\rvert\leqq10°$, $\lvert\Delta\beta\rvert\leqq10°$, and $\lvert\Delta\gamma\rvert\leqq10°$ between adjacent (100) crystal planes.

2. A highly-oriented diamond film thermistor comprising a temperature sensing part formed of a highly-oriented diamond film grown by chemical vapor deposition, in which at least 65% of the surface area of said diamond film surface consists of (111) crystal planes, and the differences {Δα, Δβ, Δγ} of Euler angles {α, β, γ}, which represent the orientations of the crystal planes, simultaneously satisfy $\lvert\Delta\alpha\rvert\leqq10°$, $\lvert\Delta\beta\rvert\leqq10°$, and $\lvert\Delta\gamma\rvert\leqq10°$ between adjacent (111) crystal planes.

3. A highly-oriented diamond film thermistor according to claim 1 wherein said highly-oriented diamond film is a p-type or n-type or intrinsic semiconducting film.

4. A highly-oriented diamond film thermistor according to claim 2 wherein said highly-oriented diamond film is a p-type or n-type or intrinsic semiconducting film.

5. A highly-oriented diamond film thermistor according to claim 3 comprising a highly-oriented intrinsic semiconducting diamond layer on which said temperature sensing part is formed.

6. A highly-oriented diamond film thermistor according to claim 4 comprising a highly oriented-intrinsic semiconducting diamond layer on which said temperature sensing part is formed.

7. A highly-oriented diamond film thermistor according to claim 1 wherein said temperature sensing part is formed by eliminating the substrate used for chemical vapor deposition of said highly-oriented diamond film.

8. A highly-oriented diamond film thermistor according to claim 2 wherein said temperature sensing part is formed by eliminating the substrate used for chemical vapor deposition of said highly-oriented diamond film.

9. A highly-oriented diamond film thermistor according to claim 1 further comprising ohmic electrodes formed on said highly oriented diamond film of said temperature sensor, and lead wires connected to said ohmic electrodes.

10. A highly-oriented diamond film thermistor according to claim 2 further comprising ohmic electrodes formed on said highly oriented diamond film of said temperature sensor, and lead wires connected to said ohmic electrodes.

11. A highly-oriented diamond film thermistor according to claim 9 wherein said ohmic electrodes are formed on both front and back surfaces of said highly-oriented diamond layer.

12. A highly-oriented diamond film thermistor according to claim 10 wherein said ohmic electrodes are formed on both front and back surfaces of said highly-oriented diamond layer.

13. A highly-oriented diamond film thermistor according to claim 5 further comprising a semiconducting diamond layer with a lower resistance than that of said temperature sensing part, the semiconducting diamond layer being formed on said highly-oriented diamond film of said temperature sensing part by either ion implantation or chemical vapor deposition; and electrodes formed on said semiconducting diamond layer.

14. A highly-oriented diamond film thermistor according to claim 6 further comprising a semiconducting diamond layer with a lower resistance than that of said temperature sensing part, the semiconducting diamond layer being formed on said highly-oriented diamond film of said temperature sensing part by either ion implantation or chemical vapor deposition; and electrodes formed on said semiconducting diamond layer.

15. A highly-oriented diamond film thermistor according to claim 1 wherein the thermistor characteristics of the highly-oriented diamond film of said temperature sensing part is controlled its electric resistance by trimming.

16. A highly-oriented diamond film thermistor according to claim 2 wherein the thermistor characteristics of the highly-oriented diamond film of said temperature sensing part is controlled its electric resistance by trimming.

17. A highly-oriented diamond film thermistor according to claim 1 further comprising an insulating passivation film covering said temperature sensing part, said insulating passivation film being formed of a material selected from the group consisting of intrinsic semiconducting diamond film, silicon oxide film, aluminum oxide film, silicon nitride film and aluminum nitride film.

18. A highly-oriented diamond film thermistor according to claim 2 further comprising an insulating passivation film covering said temperature sensing part, said insulating passivation film being formed of a material selected from the group consisting of intrinsic semiconducting diamond film, silicon oxide film, aluminum oxide film, silicon nitride film and aluminum nitride film.

* * * * *

UNITED STATES PATENT AND TRADEMARK OFFICE

CERTIFICATE OF CORRECTION

PATENT NO. : 5,512,873

DATED : April 30, 1996

INVENTOR(S) : Kimitsugu Saito, Koichi Miyata, John P. Bade, Jr., Brian R. Stoner, Jesko A. von Windheim and Scott R. Sahaida It is certified that error appears in the above-identified patent and that said Letters Patent is hereby corrected as shown below:

Column 8, Line 47, delete "its electric resistance"

Column 8, Line 51, delete "its electric resistance"

Signed and Sealed this

Seventeenth Day of September, 1996

Bruce Lehman

*Attest:*

BRUCE LEHMAN

*Attesting Officer*

*Commissioner of Patents and Trademarks*